United States Patent [19]

Singley

[11] 4,243,335

[45] Jan. 6, 1981

[54] TYPEWRITER COPY HOLDER

[76] Inventor: Ariel J. Singley, 1715 Spruce St., Napa, Calif. 94558

[21] Appl. No.: 1,895

[22] Filed: Jan. 8, 1979

[51] Int. Cl.[3] ..... B41J 29/00

[52] U.S. Cl. ..... 400/718; 40/600; 40/341; 248/442.2

[58] Field of Search ..... 400/718–718.2; 40/600, 341; 248/442.2

[56] References Cited

U.S. PATENT DOCUMENTS

| | | | |
|---|---|---|---|
| 494,305 | 3/1893 | Reid | 40/341 |
| 954,111 | 4/1910 | Knapp | 248/442.2 |
| 1,085,264 | 1/1914 | Jepson | 248/442.2 |
| 1,188,675 | 6/1916 | Olive | 248/442.2 |
| 1,328,476 | 1/1920 | Averill | 248/442.2 |
| 1,585,531 | 5/1926 | Chase | 248/442.2 |
| 2,006,887 | 7/1935 | Doherty | 248/442.2 |
| 3,837,084 | 9/1974 | Johnson | 40/600 |
| 4,074,453 | 2/1978 | Knox | 400/718 |

*Primary Examiner*—William Pieprz

[57] ABSTRACT

A device for holding different sized, flexible information carriers such as paper; soft and solid backed yieldable information carriers such as books, magazines and tablets in a correct straight forward reading position; comprising a retaining device for the flexible, yielding information carriers for at least partially rigidizing the same, and comprising a rear angled movable holding and pressure retaining device for the soft and hard backed yieldable information carriers so they are held firmly and can be adjusted to proper reading position; comprising angle bent legs for firm stabilization and proper reading angle alignment of the holding device, eliminating light glare on yieldable information carriers when holding device is placed under most business machines from the rear.

1 Claim, 5 Drawing Figures

TYPEWRITER COPY HOLDER

This invention relates to improvements in Typewriter Copy Holders. It is designed to hold all types of copy in the proper position to be read the natural way, straight forward for more efficiency and comfort and has more particular relation to improvements in such holders that only hold a single sheet of copy or those that only hold a book and sit to the side of the typist forcing side viewing.

The object of the invention is to provide a quality inexpensive typewriter copy holder that will hold all types of copy, single sheets, tablets, books and magazines so they can be viewed by typist the natural way, straight forward.

Another object of the invention is to provide a copy holder that will fit many types of business machines, typewriters, adding machines, calculators and even desk phones.

Another object of the invention is to provide the natural angle copy must be held for easy reading, eliminate light glare and allow easy access to copy.

A further object of the invention is to provide easy installation. Simply slide copy holder under machine from the back, machine holds copy holder firm.

The invention also has other objects which will be hereinafter more particularly set forth and claimed.

I represent that the prior art listed herein, other than my disclosure document filed May 19, 1978 number 071363 includes in my opinion the closest prior art of which I am aware.

In the accompanying drawing forming part of this specification,

Figure 1:
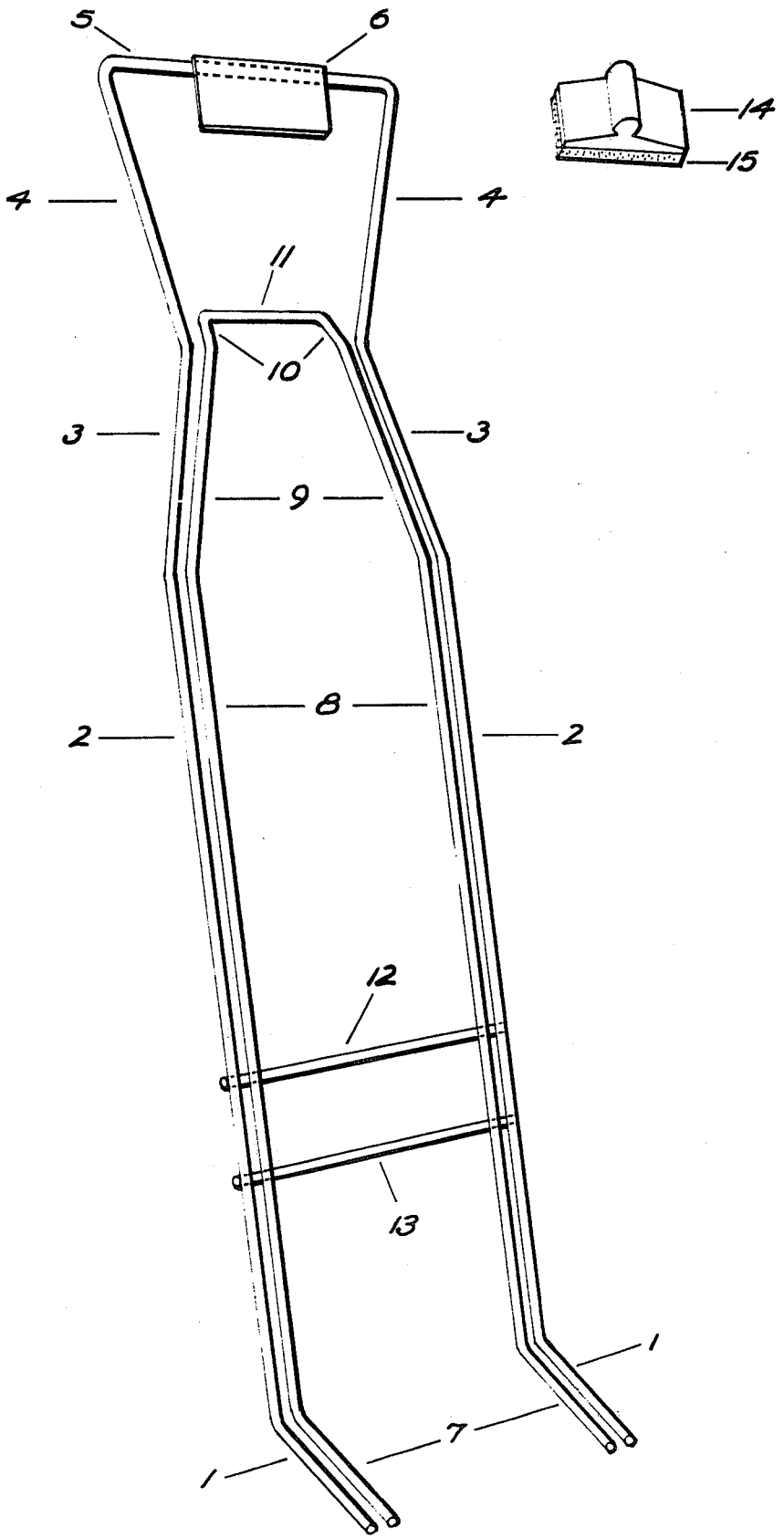
FIG. 1 represents a perspective view of the device embodying my invention.
Figure 2:
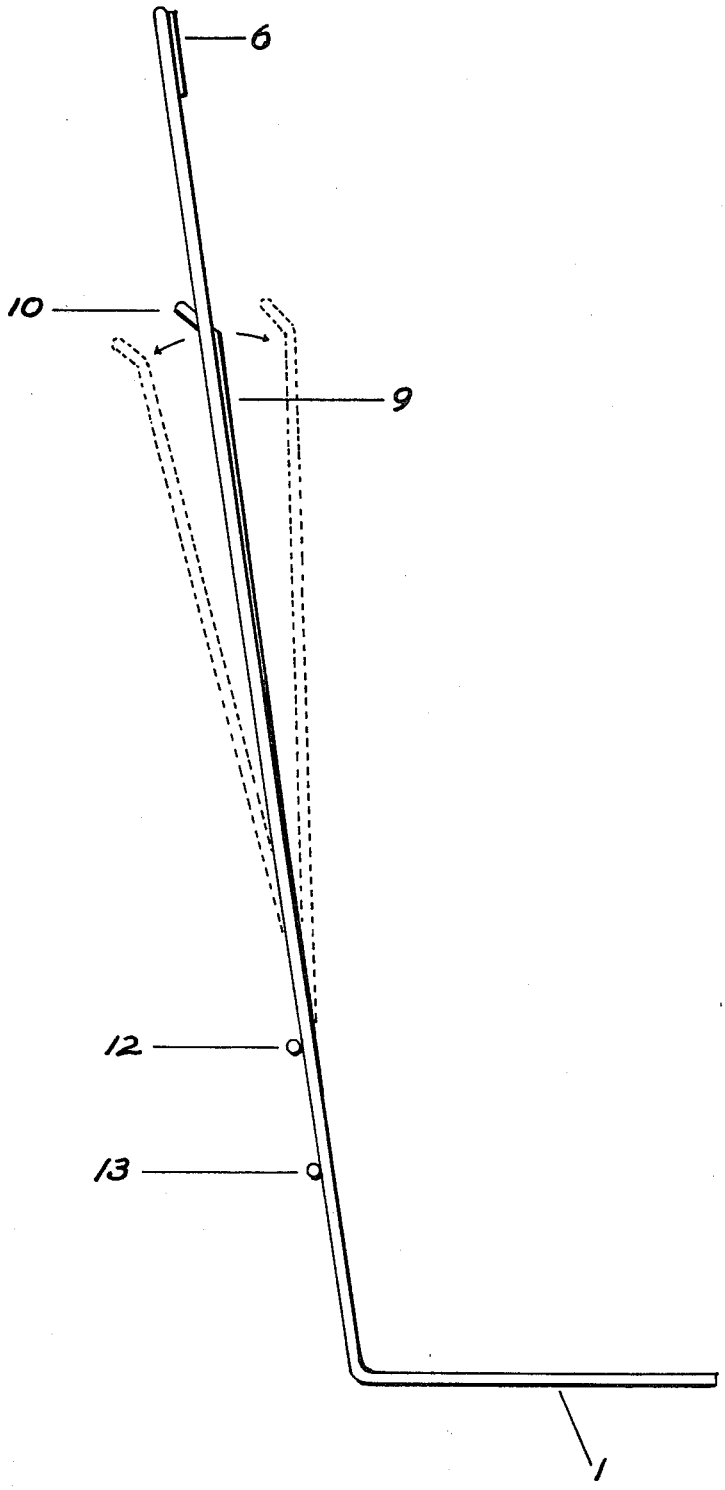
FIG. 2 represents side view showing copy holders inner frames' flexibility to move backward and forward when needed.
Figure 3:
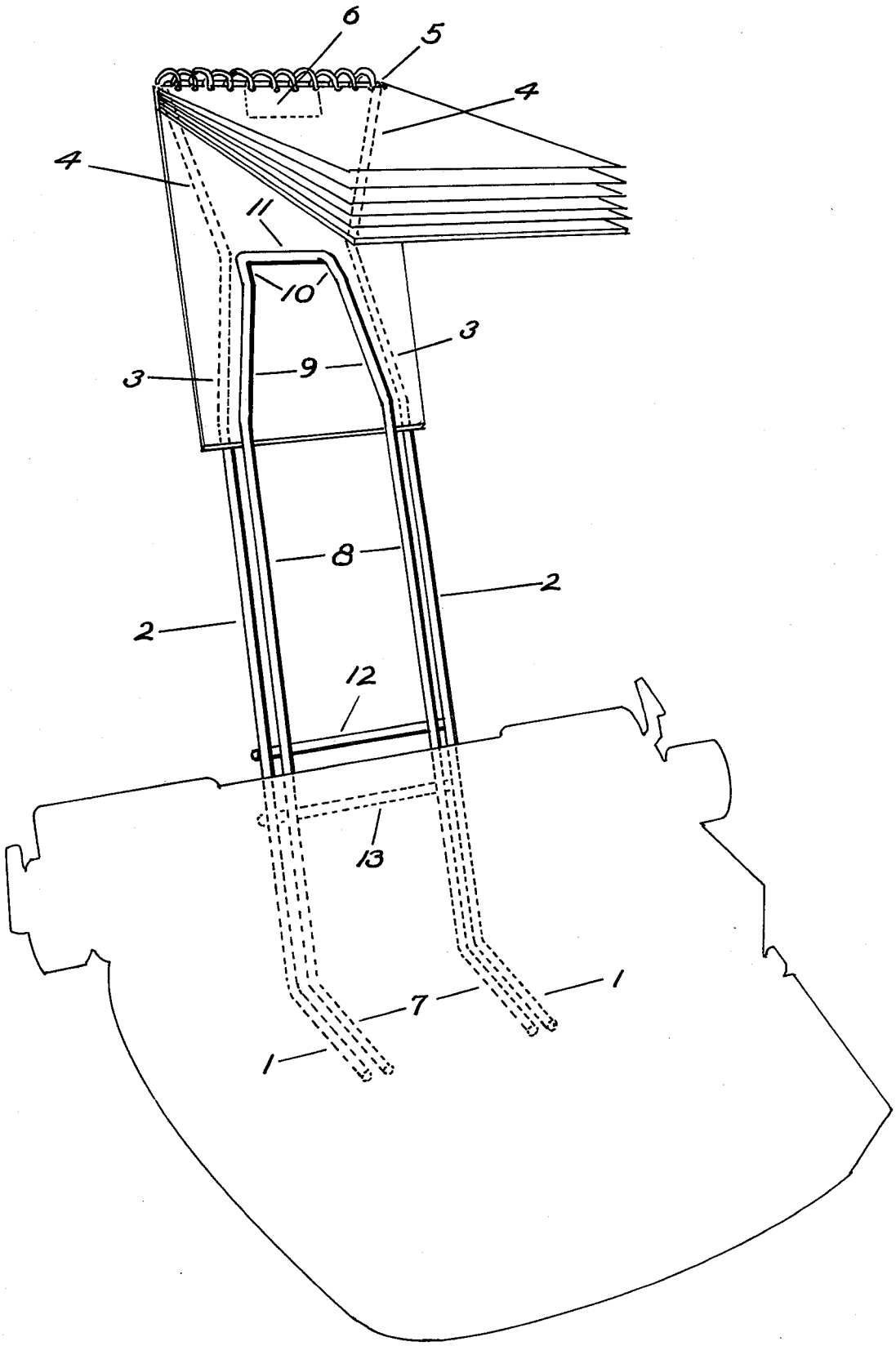
FIG. 3 represents copy holder's ability to hold tablets for individual page flip over.
Figure 4:
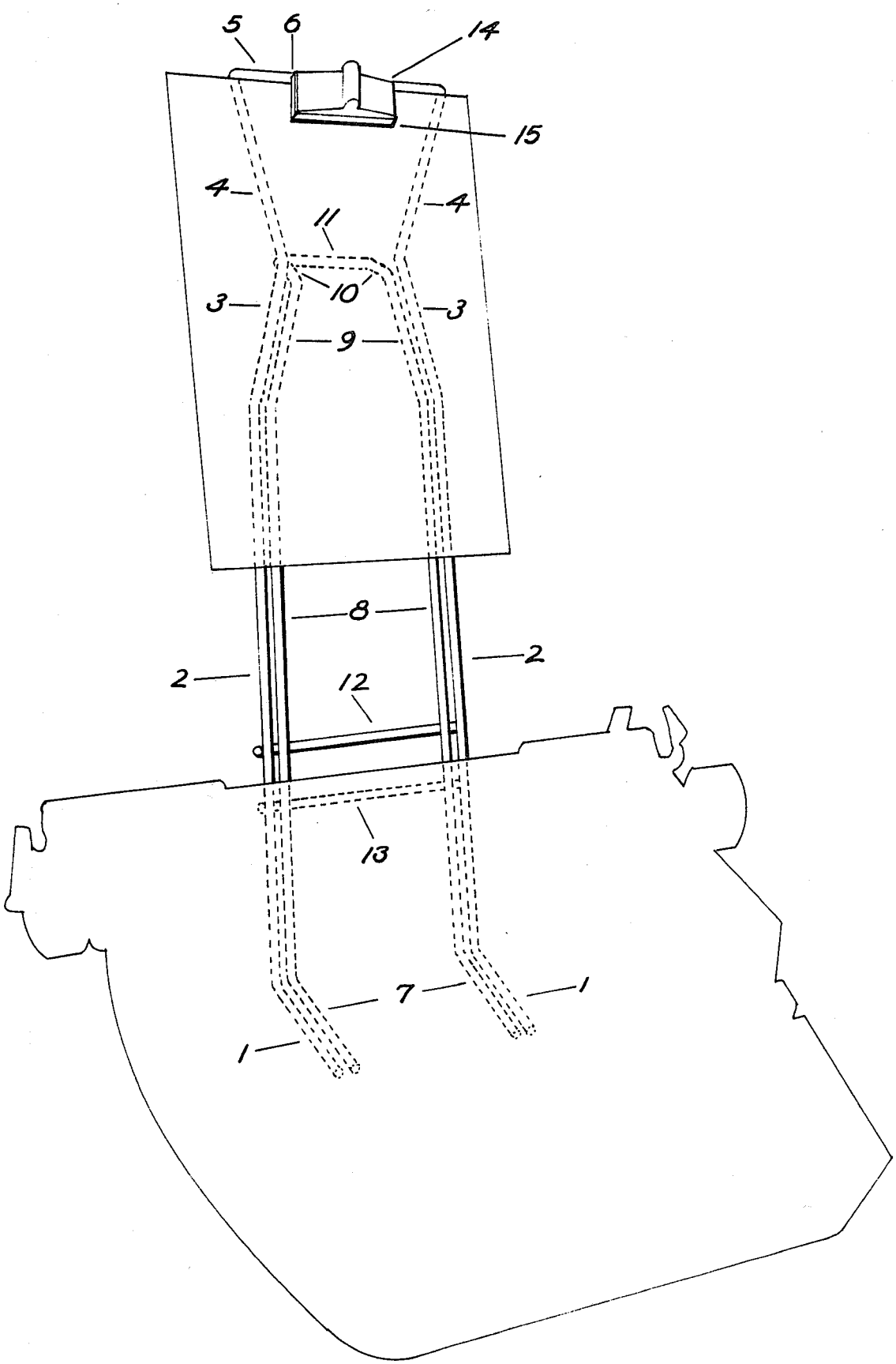
FIG. 4 represents copy holder's ability to hold single sheet of copy.
Figure 5:
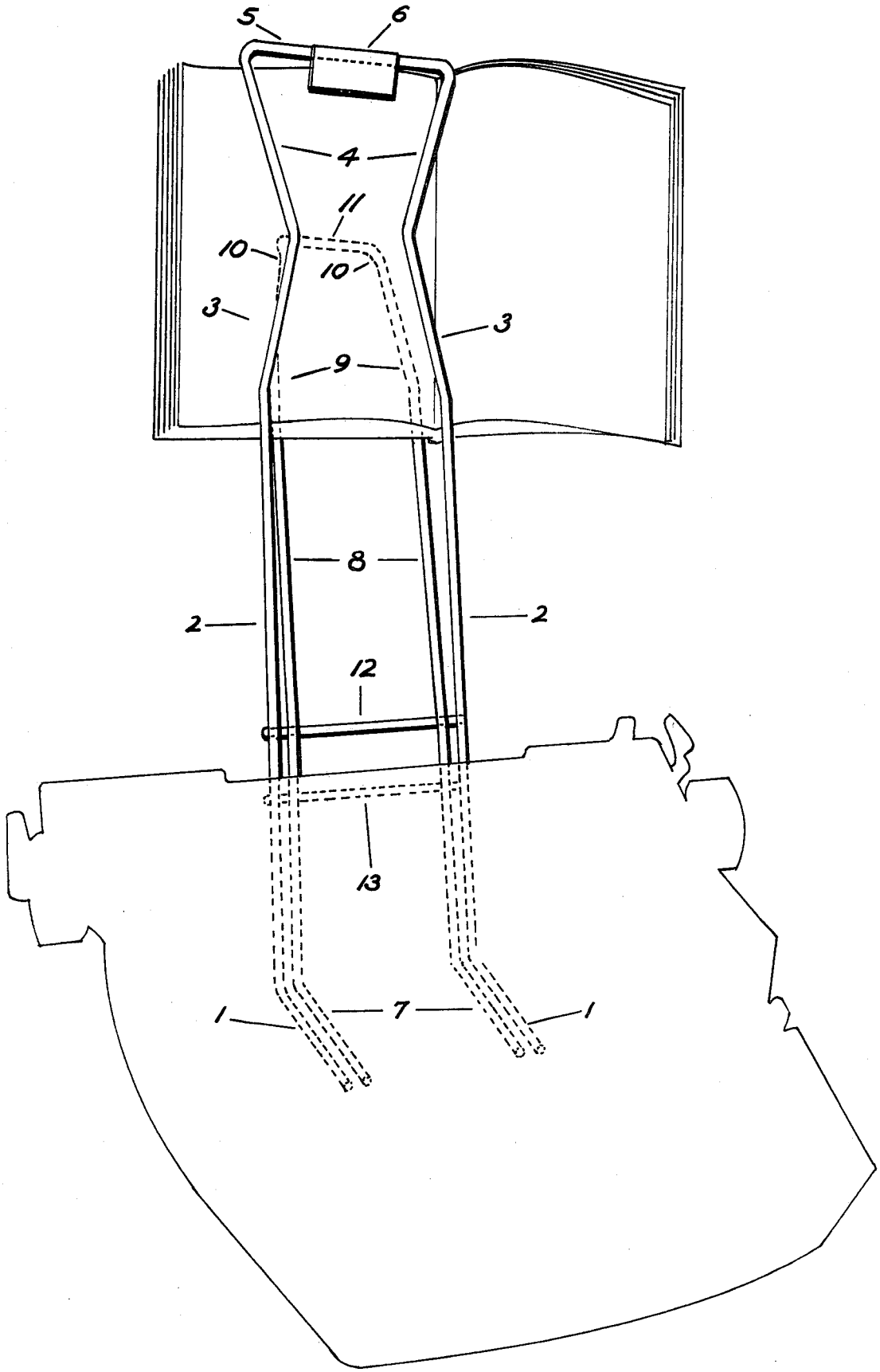
FIG. 5 represents copy holder's ability to hold soft and hard cover books.

Of course holders of wire are very old in the art, and applicant makes no claims on such. But holders made of wire or light metal and capable of holding all types of copy, regular, legal, steno, memo size sheets, tablets, pads, soft and hard cover books and magazines at natural viewing angle and held firmly under machine for straignt forward viewing by typist is new as far as applicant is aware.

Of course magnet holders of plastic are very old in the art as are magnetized vinyl tapes and applicant makes no claims on such. But one piece custom designed oblong magnet holders with handle made of plastic with vinyl magnetic tape adhered to bottom of holder for holding single or multiple sheets of copy to a metal plate of a straight forward viewing typewriter copy holder is new as far as applicant is aware.

This invention described in detail, comprises of one taller outer wire frame with angle bent legs 1 to force outer frame to proper angle. Long straight section 2 is for height. Angle bend inward 3 and angle bend outward 4 is to keep narrow tablet back cover stable. Angle bend 5 is to complete outer frame and to serve as a base for welded on metal plate 6. Metal plate 6 is base for magnet holder 14 and magnet 15. By placing a single sheet of copy on plate, placing magnet holder over both, copy is held firmly.

Shorter inner wire frame fits inside outer wire frame side by side leaving a narrow space between the two frames. Angel bent legs 7 to force inner frame to proper angle matching outer frame legs. Long straight section 8 is for height. Angle bend inward 9 is to match inward bend 3 of before mentioned outer frame. Protrusion angle 10 towards rear is for tension against tablet back cover holding it firmly when slid between inner and outer frames for single page flip over use. Angle bend 11 is to complete inner frame. Steel wire rods 12 and 13 are welded across inner and outer frames from the back close to the legs to form a common frame. Outer frame remains rigid while inner frame can be moved forward or backward as desired.

Magnet holder 14 is a one piece oblong molded plastic magnet holder with handle. Magnet 15 is a magnetic vinyl tape with adhesive back that is firmly adhered to the bottom of magnet holder 14. The complete unit is used to hold single or multiple sheets of copy firmly on plate 6.

My invention increases speed and accuracy, decreases strain of eyes, neck and back by offering straight forward viewing, the natural way of viewing copy by the typist for more efficiency and comfort. Easy to install under most business mahines from the rear and holds all types of copy: regular, legal, steno, memo size sheets, pad or tablet. Also holds soft and hard back cover books and magazines. All held at the natural angle for easy reading, eliminating light glare and allowing easy access to copy.

Having now described my invention, what I claim as new and desire to secure by letters patent is:

1. A holding device for firmly holding flexible, yieldable information carriers such as paper; soft and solid backed yieldable information carriers such as books, magazines and tablets in a correct straight forward readable position, eliminating light glare, comprising:

a first, upright, outer, taller, metal frame of generally U-shaped configuration having a topmost connecting portion and a downwardly projecting leg extending from each opposite end of said connecting portion, each said legs being provided with identical inward and then outward bends adjacent said connecting portion, said legs then extending generally parallel to each other downwardly to their free ends, said connecting portion being provided with a short oblong metal surface fastened to the connecting portion at the center thereof, a second, upright, metal frame of generally U-shaped configuration, said second frame being shorter and narrower than said first metal frame so as to fit within said first frame, the legs of said second frame adjacent the connecting portion thereof being provided with an outward bend corresponding to said outward bend of the legs of said first frame, the portion of said second frame adjacent its upmost connecting portion being provided with a rearwardly protruding bend so that said second frame connecting portion lies in a plane rearwardly of the plane of said first metal frame, while the legs of the second frame beyond the said outward bend are parallel to and generally in the plane of the first frame legs, the free ends of the legs of both said first and second frames being provided with a substantially right angle bend out of the plane of the first frame so as to enable the free ends to rest on a support surface and maintain the remainder of said frame in substantially upright position, and wherein said holding device becomes operational by combining the above mentioned elements, the second said shorter metal frame is set inside first said taller metal frame; by fastening two metal rods across the backs of said frames, leaving a narrow width between said frames, both said frames thus become a common frame allowing the first said frame to remain rigid; the identical inward and outward angle bends on two opposite sides near the top of first said frame serves as stable backing for different sizes and types of yieldable information carriers, the second said frame is allowed to be moved freely back and forth serving as a movable holder and pressure retaining device for the soft and solid backed yieldable information carriers when backings of said carriers are slid between first and second said frames; the one piece plastic magnet holder with handle, a magnetic tape surface fastened to holder serves as a securing device for clamping the flexible, yieldable information carriers in a freely supported reading position when fastened to said short oblong metal surface, the bent free ends of the legs of said first and second frames serve for firm stabilization and proper reading angle alignment of said holding device, eliminating light glare on yieldable information carriers when said holding device is placed under most business machines from the rear.

* * * * *